United States Patent [19]

Kawazu et al.

[11] 4,348,103

[45] Sep. 7, 1982

[54] CLEANING APPARATUS FOR PHOTOSENSITIVE MEMBER OF ELECTROPHOTOGRAPHIC COPYING MACHINE

[75] Inventors: Hideyuki Kawazu; Yoshiro Suzuki, both of Hachioji, Japan

[73] Assignee: Olympus Optical Company Ltd., Tokyo, Japan

[21] Appl. No.: 282,920

[22] Filed: Jul. 13, 1981

[30] Foreign Application Priority Data

Jul. 14, 1980 [JP] Japan ..... 55-98927[U]

[51] Int. Cl.[3] ..... G03G 21/00

[52] U.S. Cl. ..... 355/15; 15/256.52

[58] Field of Search ..... 355/15, 3 R; 15/256.52; 134/6, 7

[56] References Cited

U.S. PATENT DOCUMENTS

| | | | |
|---|---|---|---|
| 3,590,412 | 7/1971 | Gerbasi | 355/15 X |
| 3,644,959 | 2/1972 | Ohta | 15/256.52 |
| 3,722,018 | 3/1973 | Fisher | 15/256.52 |
| 3,850,521 | 11/1974 | Saupe | 15/355 |
| 3,955,235 | 5/1976 | Meyer | 15/256.52 |
| 4,095,980 | 6/1978 | Satomi | 15/256.52 |
| 4,123,154 | 10/1978 | Fisher | 15/256.52 |
| 4,172,303 | 10/1979 | Wooding et al. | 15/256.52 |
| 4,319,832 | 3/1982 | Sakamoto et al. | 355/15 |

*Primary Examiner*—Richard L. Moses

*Attorney, Agent, or Firm*—Weinstein & Sutton

[57] ABSTRACT

A cleaning apparatus for a photosensitive member of an electrophotographic copying machine is provided. The apparatus comprises a cleaning brush disposed for contact with a photosensitive drum while rotating in order to remove unnecessary developing toner which attaches to the drum, means for moving the cleaning brush into contact with or away from the drum, a striker rod to strike off the toner attaching to the cleaning brush, and trap means for collecting the toner which is removed by the cleaning brush and the striker rod. An arrangement is made to cause an angular movement of the striker rod to change its surface for abutment against the brush in association with the movement of the cleaning brush into contact with or away from the photosensitive drum.

6 Claims, 6 Drawing Figures

CLEANING APPARATUS FOR PHOTOSENSITIVE MEMBER OF ELECTROPHOTOGRAPHIC COPYING MACHINE

BACKGROUND OF THE INVENTION

The invention relates to a cleaning apparatus for a photosensitive member of an electrophotographic machine, and more particularly, to such apparatus in which a developing toner which remains attached to a photosensitive member carrying an electrostatic latent image is removed by utilizing a rotating cleaning brush.

As is well recognized, for an electrophotographic copying machine of the dry type which utilizes a developing toner in the form of powder, a cleaning apparatus is used to remove unnecessary developing toner which remains attached to a photosensitive member carrying an electrostatic latent image after a toner image has been transferred onto a record sheet. A variety of cleaning apparatus have been proposed in the prior art. However, such apparatus generally comprises a rotating cleaning brush disposed for contact with the photosensitive member, in combination with a toner trap associated with the brush for collecting the toner removed by the brush. The trap includes a filter which prevents the removed toner from dispersing into and outside the machine, and suction means.

A cleaning apparatus of such kind is associated with a striker rod disposed for abutment against the cleaning brush so that the toner attaching to the brush may be shaken off therefrom. The rod strikes the brush to remove the toner therefrom, and is provided because the efficiency to remove toner from the photosensitive member degrades and the dispersion of the toner tends to increase as the cleaning apparatus continues to be used over a prolonged period of time. Howe~~ver,~~ it is found that as the striker rod becomes contaminated by the deposition of the toner, there occurs a phenomenon called a filming on the surface of the photosensitive member, resulting in a substantial degradation in the image quality achieved.

In the cleaning apparatus described above, the cleaning brush contacts the surface of the photosensitive member while rotating in order to remove any residual toner from such surface. However, the cleaning action does not remain perfect, but after a given period of use, a thin film of toner is formed on the surface of the photosensitive member to cause an adverse influence upon the copying operation. Such formation of a toner film is referred as a filming phenomenon. The purpose of the striker rod is to prevent the occurrence of such a filming phenomenon. However, experiments have shown that a strong adherence of the toner onto the surface of the rod or a local abrasion produced in the rod results in a decreased cleaning effect leading to the occurrence of a filming phenomenon.

It is also found by experiments that the striker rod may be temporarily rotated to change its surface adapted to engage the brush in order to avoid the above disadvantage. The number of revolutions of the rod may be as low as one revolution per one thousand copies.

An electrophotographic copying machine of the type described is usually designed to provide a multiple copy operation in which a single electrostatic latent image formed by one exposure is utilized to produce a plurality of copies. During a multiple copy operation, a toner developing step and a transfer step are repeated with a common latent image, and hence an exposure unit, a charger, a cleaning apparatus and a neutralizer lamp are left inoperative. Also the cleaning brush is arranged to be movable into contact with or away from the photosensitive member so that it may be left inoperative during such operation in order to avoid any degradation in the quality of the latent image. At this end, the rotatable brush is supported by a pair of rockable arms, so that the arms may be rocked to move the brush into contact with or away from the photosensitive member.

SUMMARY OF THE INVENTION

It is an object of the invention to provide a cleaning apparatus for the photosensitive member of an electrophotographic copying machine including a cleaning brush supported by rockable arms so as to be movable into contact with or away from a photosensitive member and associated with a striker rod which may be driven for angular movement by utilizing the oscillation of the support arms.

In the arrangement of the invention, the striker rod is driven for angular movement in association with a movement of the cleaning brush into contact with or away from the photosensitive member, thereby changing its surface adapted to bear against the brush. In this manner, the toner deposition on the surface of the striker rod is substantially eliminated, and the rod remains to be effective over a prolonged period of use to enable an effective removal of developing toner which remains attached to the cleaning brush. This prevents a filming phenomenon from occurring on the surface of the photosensitive member, assuring the production of copies of a high image quality over a prolonged period of use of the machine.

The striker rod is driven for angular movement by utilizing the oscillation of the support arms associated with the cleaning brush. No separate drive is required, and the transmission used comprises a ratchet wheel and a feed pawl associated therewith, thus providing a very inexpensive arrangement.

DESCRIPTION OF THE PREFERRED EMBODIMENT

Figure 1:
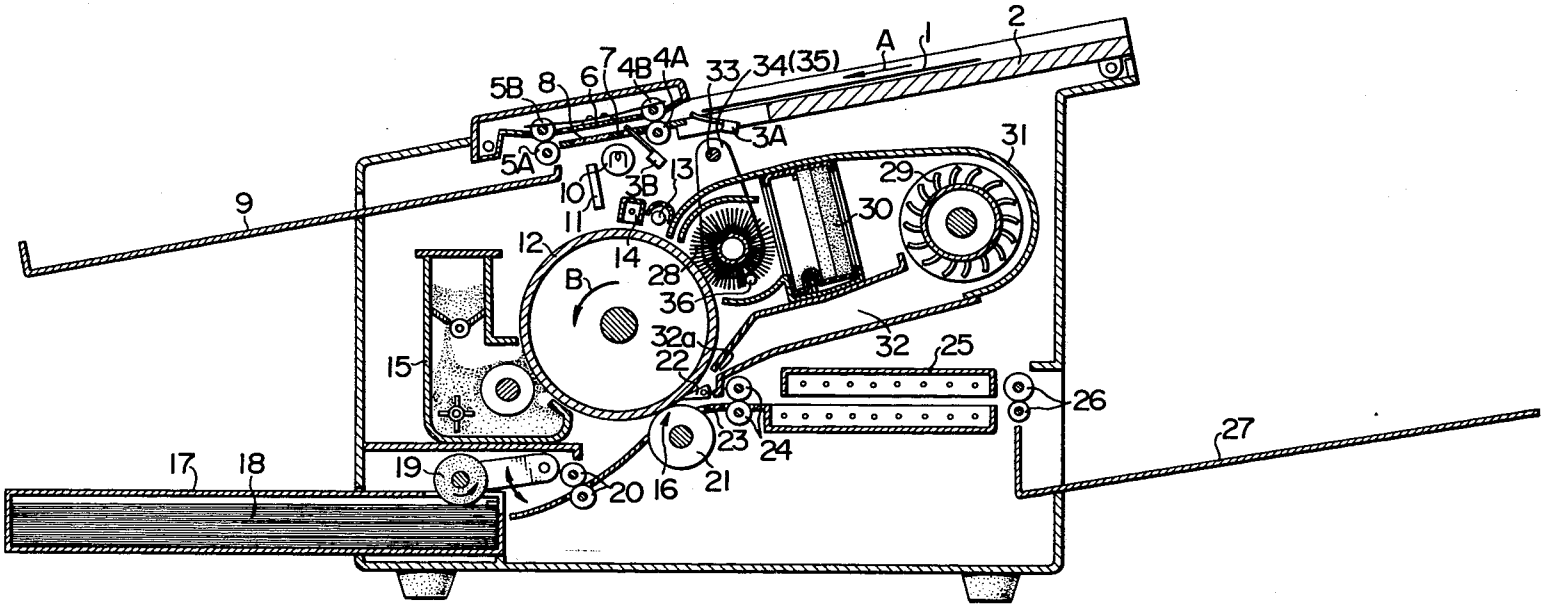
FIG. 1 is a vertical section of an exemplary electrophotographic copying machine to which the invention is applied.

FIG. 1 shows an electrophotographic copying machine to which the invention is applied. The machine is designed to produce a copy by feeding an original into an exposure station. In its normal position, an original feed path is defined in the machine so as to allow a copying from a single sheet-shaped original, as shown. Under this condition, a sheet-shaped original 1 is placed on an inclined original receptacle 2 to be inserted in a direction indicated by an arrow A into the inlet of an original feeder including pairs of conveying rollers 4A, 4B, 5A, 5B and guide plates 6, 7. Initially, as the leading end of the original is inserted into the nip between the pair of vertically aligned conveying rollers 4A, 4B, it is fed toward an exposure station 8 while passing between the guide plates 6, 7 and between the guide plate 6 and the exposure station 8. After passage through the exposure station 8, the original 1 is further fed by another pair of conveying rollers 5A, 5B to be delivered onto an original tray 9.

As the original 1 is fed by the original feeder, microswitches 3A, 3B located in front of and after the pair of conveying rollers 4A, 4B detect the position of the original 1 to provide outputs which are utilized to control the timing of the operation of variable parts of the machine. As the original 1 passes through the exposure station 8, its surface is illuminated by an illumination lamp 10, and the image of the original is projected by an exposure optics 11 onto a drum 12 which represents a photosensitive member. The drum 12 is adapted to rotate in a direction indicated by an arrow B, and before it is irradiated by the optical image of the original, the drum is electrically neutralized by a neutralizer lamp 13 and then uniformly charged by a corona charger 14. In response to the irradiation, an electrostatic latent image of the original 1 is formed on the drum surface, and is then developed with the toner by a developing unit 15 of the dry type, thereby forming a toner image. As the drum 12 continues to rotate, the toner image is carried to a transfer station 16.

On the other hand, a number of record sheets 18 are disposed in a stack within a cassette 17, and are fed one by one by an oscillating and rotating feed roller 19. A pair of vertically aligned feed rollers 40 conveys the separated record sheet into the transfer station 16 at a given timing. The record sheet is fed into the nip between the drum 12 and a transfer roller 21 to which a bias voltage is applied, so that it can be brought into superimposed relationship with the toner image carried by the drum, thus transferring the toner image from the drum onto the record sheet. Since the record sheet is conveyed in close contact with the drum 12 during such process, it is separated therefrom by the action of a separating claw 22 and an airstream to be described later. The record sheet having the toner image transferred thereto is then conveyed along a guide plate 23 and then conveyed by a pair of vertically aligned feed rollers 24 into a heat fixing unit 25 including a heater where the toner image is melted to be fixed. Finally, the record sheet is conveyed by a pair of vertically aligned delivery rollers 26 onto a copy tray 27.

A quantity of developing toner which remains on the photosensitive drum 12 without being transferred onto the record sheet is scraped off by a rotating cleaning brush 28 and is withdrawn by an airstream created by a fan 29 to be collected by a filter 30. A striker rod 36 is disposed for contact with the brush 28 in order to strike the brush to remove the toner attaching thereto. Both the cleaning brush 28 and the fan 29 are covered by a casing 31 which is provided in order to produce an effective removal of the residual toner and to prevent dispersion of the toner into the machine. The airstream discharged by fan 29 is introduced into a duct 32 having its outlet port 32*a* located adjacent to the transfer station 16 so that the airstream may be utilized to provide an effective separation of the record sheet from the drum 12, by cooperating with the separating claw 22.

As mentioned previously, the machine is designed to produce a plurality of copies in succession by repeating the toner developing and the transfer step with a single electrostatic latent image which is once formed on the drum 12. During such operation, the cleaning brush 28 is maintained away from the drum 12 and both the neutralized lamp 13 and the charger 14 are left inoperative. At this end, the brush 28 is carried by a pair of support arms 34, 35 which are rockably mounted on a support shaft 33.

Figure 2:
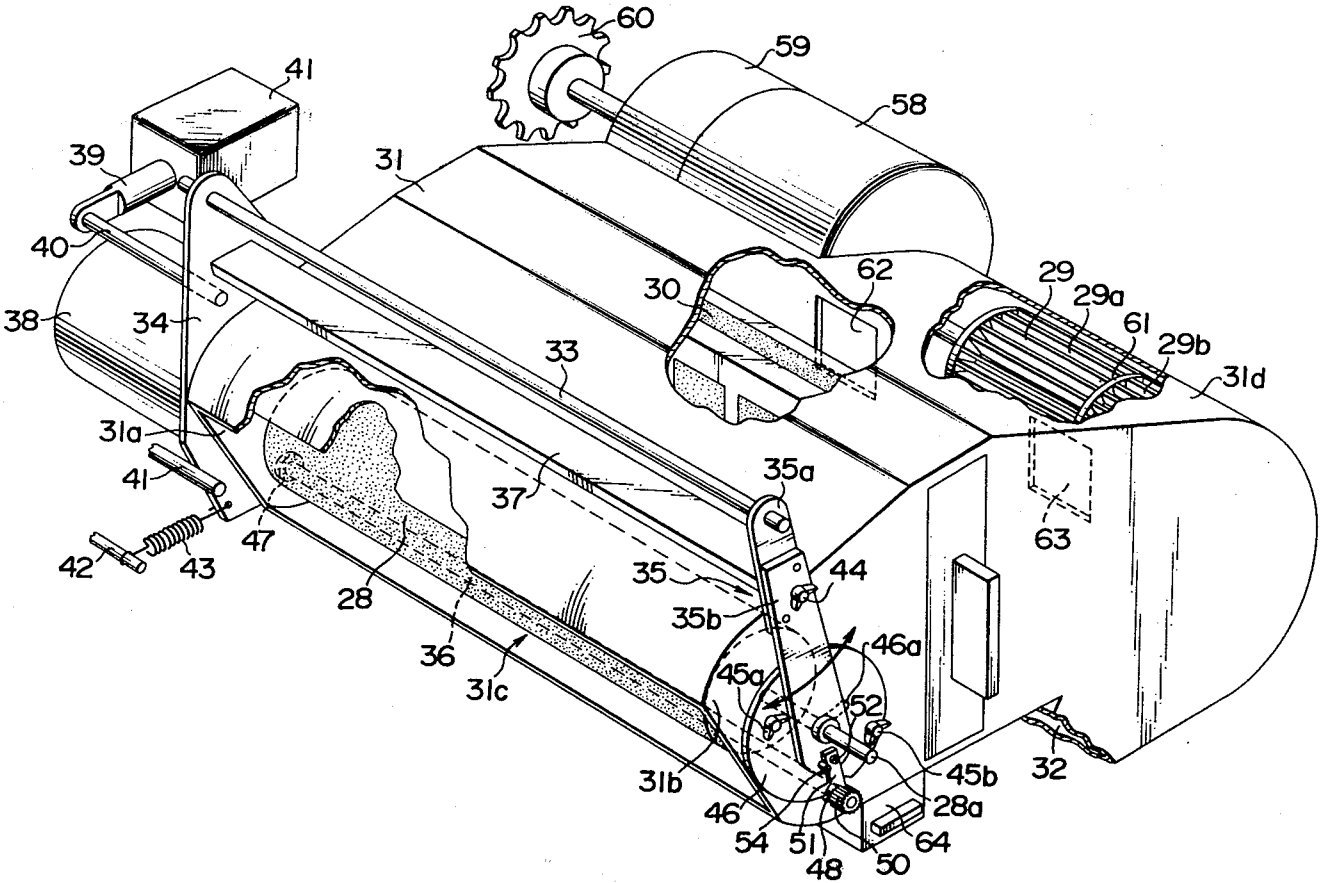
FIG. 2 is a perspective view of a cleaning apparatus according to one embodiment of the invention.

The cleaning apparatus of the invention may be applied to such copying machine. Referring to FIG. 2, there is shown a cleaning apparatus according to one embodiment of the invention, in perspective view. As shown, the cleaning brush 28 includes a rotary shaft 28*a* which has its opposite ends rotatably carried by the free end of the pair of support arms 34, 35, and the brush itself is disposed within the casing 31. One end of each arm 34, 35 is rotatably mounted on a support shaft 33 which is stationary, and the both arms are interconnected by a connecting member 37 so as to be integrally rockable about the shaft 33. It will be noted that the both arms are located outside the casing 31. The casing 31 includes a left-hand sidewall 31*a* in which an arcuate slot (not shown) is formed, through which one end of the rotary shaft 28*a* extends and is rotatably carried by the support arm 34. A brush drive motor 38 is mounted on the support arm 34 for driving the cleaning brush 28 for rotation. A solenoid 41 is connected with the support arm 34. Specifically, the solenoid 41 includes a plunger 39 which is coupled with a connecting rod 40 fixedly mounted on the support shaft 34. To enable a multiple copy operation, the solenoid 41 is energized to attract the plunger 39, thus causing the support 34 to rock counter-clockwise about the shaft 33 through the connecting rod 40 in order to move the brush 28 away from the drum 12. However, the support arm 34 is normally urged by a coiled tension spring 43, extending across the arm 34 and the stationary pin 42, to rotate clockwise about the shaft 33, thus maintaining the brush 28 in contact with the drum 12. Such position is limited by a stop pin 41.

The other support arm 35 comprises a pair of arms 35*a*, 35*b* which are integrally connected together by a set screw 44. The arm 35*a* has its one end rotatably mounted on the shaft 33 while the remote end of the arm 35*b* rotatably carries the rotary shaft 28*a* of the brush 28. The purpose of such arrangement is to facilitate the removal of the brush 28 out of the casing 31 when it is desired to replace the cleaning brush 28 during a cleaning or the maintenance of the cleaning unit or the replacement of the brush. At this end, the right-hand sidewall 31*b* of the casing 31 is formed with a circular opening (not shown) which is slightly greater than the diameter of the brush 28 and which is normally closed by a disc 46 which is secured to the sidewall 31*b* by means of set screws 45*a*, 45*b*. The disc 46 is formed with an arcuate slot 46*a*, through which the adjacent end of the rotary shaft 28*a* of the brush 28 extends to be rotatably carried by the arm 35*b*. Consequently, by releasing the set screw 44 to disengage the arm 35*b* from the other arm 35*a*, and by removing the disc 46 from the right-hand sidewall 31*b*, the brush 28 can be easily withdrawn out of the casing 31 through the circular opening.

A striker rod 36 is disposed below the cleaning brush 28 and is rotatably supported in the both sidewalls 31*a*, 31*b* by means of bearings 47, 48. The striker rod 36 is located so as to be maintained in contact with the brush 28 when the brush 28 assumes either position in contact with or away from the drum 12. A ratchet wheel 50 is fixedly mounted on the right-hand end of the striker rod 36 which extends through the right-hand sidewall 31*b* to be positioned below the support arm 35*b*, for causing an angular movement of the rod 36.

Figure 5:
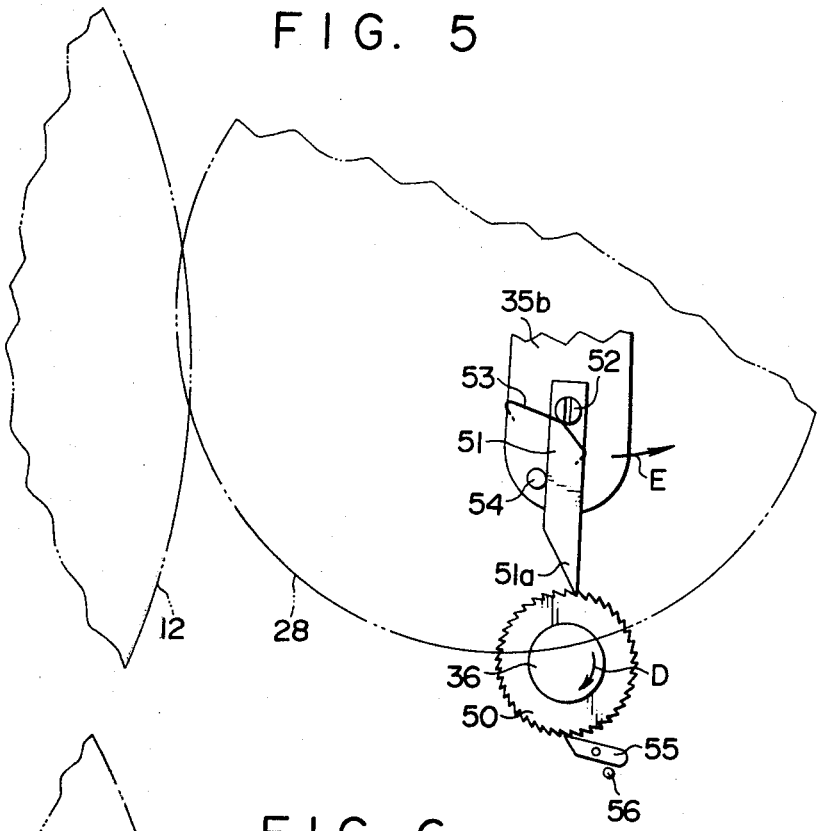
FIG. 5 is a front view of a drive transmission mechanism associated with a striker rod.

As shown in FIG. 5, a feed pawl 51 is rockably mounted on the free end of the arm 35*b* by means of a pin 52, and includes a pawl tip 51*a* which extends beyond the arm 35*b* for engagement with the ratchet wheel 50. The feed pawl 51 is urged by a torsion spring 53, wrapped around the pin 52 and having its one end engaged with the arm 35*b* and its other end engaged with the body of the feed pawl 51, to move clockwise about the pin 52. However, the resulting angular movement is limited by a stop pin 54 fixedly mounted on the arm 35*b*. When the pawl abuts against the stop pin 54, the pawl tip 51*a* is disposed to engage the ratchet wheel 50. The ratchet wheel 50 is formed with a saw-toothed edge, and as the arm 35*b* rocks in a direction indicated by an arrow E to move the brush 28 away from the drum 12, the pawl tip 51*a* which engages one of the teeth on the ratchet wheel 50 also angularly moves in the same direction to rotate the ratchet wheel 50 clockwise by one pitch, or an increment corresponding to one of the teeth formed thereon. It is to be noted that the ratchet wheel 50 is also engaged by a detent pawl 55 for preventing a rotation of the wheel 50 in the opposite or counter-clockwise direction. The position of the detent pawl 55 is controlled by a stop pin 56.

Returning to FIG. 2, the fan 29 disposed inside the casing 31 is formed by a sirocco fan in the present embodiment, which is arranged to withdraw toner removed by the brush 28 and the toner shaken off the brush 28 by the striker rod 36 into the casing 31 through a front opening 31*c* formed in the casing. In the present embodiment, the fan 29 is driven by a motor 58 which is mounted in coaxial relationship with the rotary shaft of the fan. As shown, a portion 31*d* of the casing 31 which houses the fan 29 therein has a reduced width as compared with the width of the front opening 30*c* so that the motor 58 may be disposed in the space thus created. It should be understood that the motor 58 represents a main motor of the copying machine, and has its output shaft connected through a speed reducing unit 59 to drive a sprocket wheel 60, thus supplying power therefrom.

Since the motor 58 is disposed in a space defined by the outer dimensions of the casing 31, the fan 29 is located at an offset position from the center of the casing 31, or toward the right-hand end, as viewed in FIG. 2. Accordingly, to produce a uniform suction throughout the full width of the front opening 30*c*, the fan 29 is divided into left and right fan sections 29*a*, 29*b* by a partition 61, with the left fan section 29*a* being made to produce a greater suction than the right fan section 29*b*, by increasing the length of the rotating blades provided thereon. Suction openings 62, 63 are formed in front of the respective fan sections 29*a*, 29*b* for communication with the opening 31*c*. The resulting airstream is effective to provide a uniform withdrawal of the toner scraped off the drum 12 by the cleaning brush 28 into the casing 31 through the opening 31*c*. Such toner is subsequently trapped by the filter 30, with larger toner particles falling down in front of the filter 30 to be collected by a toner sump 64. Small toner particles are trapped by the filter 30. As mentioned previously, the airstream discharged by the fan 29 is fed through the duct 32 (FIG. 1) to be utilized in separating the record sheet from the drum.

Figure 3:
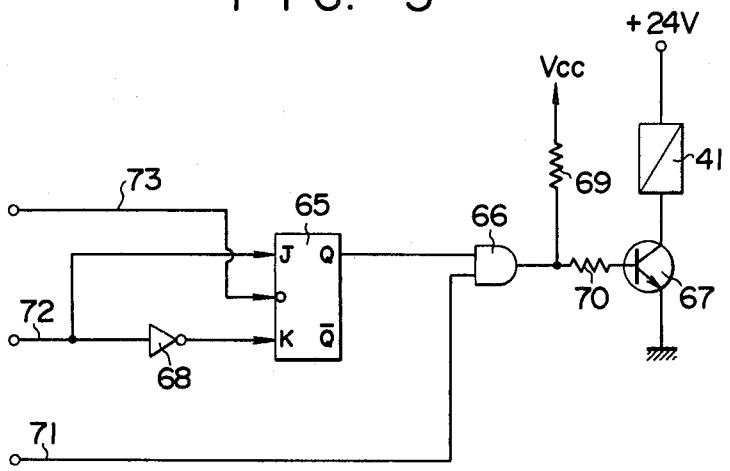
FIG. 3 is a circuit diagram of an electrical circuit which controls the movement of the cleaning brush into contact with or away from the photosensitive member.

FIG. 3 shows a control circuit which controls the movement of the cleaning brush 28 into contact with or away from the drum 12 in accordance with the number of copies to be produced. The circuit comprises a J-K flipflop 65, AND gate 66, a switching transistor 67 and an inverter 68, all connected as shown, to control the energization of the solenoid 41. It will be noted that a bias voltage Vcc is applied to the base of the transistor 67 through resistors 69, 70.

During the time the fan 29 and brush 28 are maintained in rotation, an input voltage of high level is applied to an input terminal 71 to enable AND gate 66, and another input voltage of high level is also applied to an input terminal 72 in response to a count from a copy counter (not shown) which indicates the number of remaining copies to be produced during a multiple copy operation.

Figure 4:
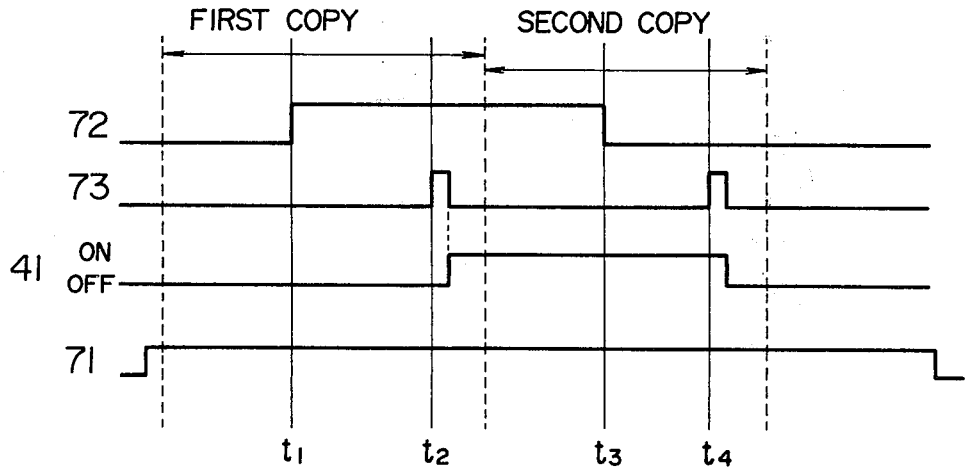
FIG. 4 shows a series of timing charts illustrating the operation of the circuit shown in FIG. 3.

FIG. 4 shows a series of timing charts which illustrate the operation of the control circuit. By way of example, when two copies are produced from a single exposure, an initial count of "2" is loaded into the copy counter. At time $t_1$ during the first revolution of the drum, the fact is detected that more than one copy is to be produced, applying a high level input to the input terminal 72. At time $t_2$ when the cleaning brush 28 is to be moved away from the drum 12, a timing pulse is applied to an input terminal 73, which causes the flipflop 65 to invert, whereupon a high level output signal is produced at its Q terminal, which is passed through gate 66 to be applied to the transistor 67, thus rendering it conductive to energize the solenoid 41. In this manner, the cleaning brush 28 is moved away from the drum.

During the latter half of the first revolution of the drum, the copy counter counts down, and at time $t_3$ during the second revolution of the drum 12, the fact is detected that the remaining number of copies is one, whereby a low level input is applied to the input terminal 72. When a timing pulse is applied to the input terminal 73 at time $t_4$ when the cleaning brush 28 is to be activated, the flipflop 25 inverts again to produce a low level Q output, which deenergizes the solenoid 41, allowing the cleaning brush 28 to be returned to its position where it engages the drum 12, under the resilience of the spring 43 (FIG. 2).

Figure 6:
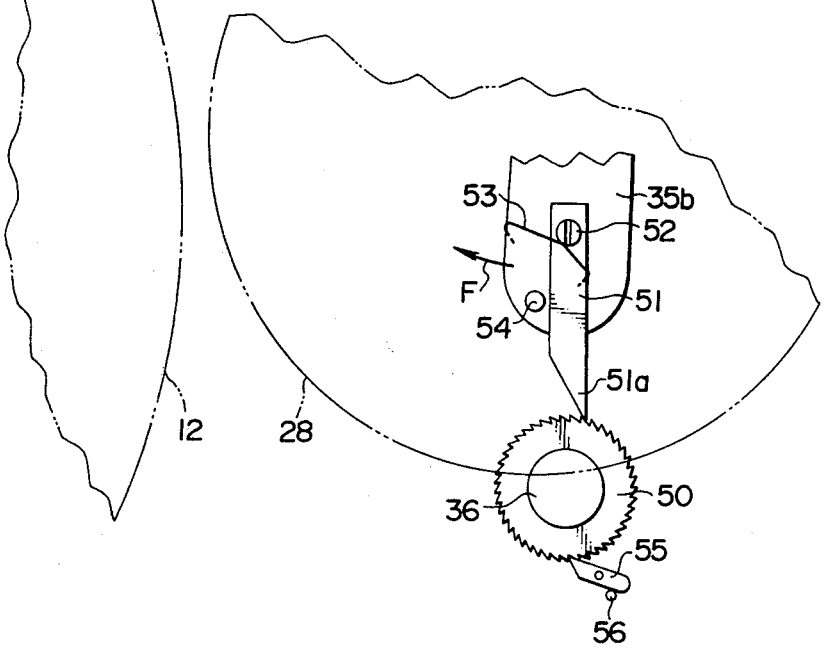
FIG. 6 illustrates the operation of the transmission mechanism shown in FIG. 5.

Referring to FIGS. 5 and 6, the operation of the striker rod 36 will now be described. FIG. 5 illustrates that the cleaning brush 28 is disposed in contact with the drum 12 to remove unnecessary toner which remains on the drum surface. When a command indicating a multiple copy operation is produced, the solenoid 41 is energized in the manner mentioned above to move the arm 35*b* in the direction indicated by the arrow B. Since the feed pawl 51 abuts against the pin 54 to be integral with the arm 35*b* and the pawl tip 51*a* is engaged with one of teeth on the ratchet wheel 50, the latter is angularly driven by the pawl tip 51*a* in a direction indicated by an arrow D or clockwise by one pitch to assume the condition shown in FIG. 6. At this time, the brush 28 remains at rest while being maintained away from the drum 12.

As mentioned above, as the brush 28 is moved away from the drum 12, the ratchet wheel 50 is angularly driven by one pitch in association with such movement, thus causing a small rotation of the striker rod 36 to change its surface area which engages the brush 28. When the solenoid 41 is deenergized upon completion of producing a plurality of copies, the coiled spring 43 (FIG. 2) causes the arm 35*b* to rotate in the direction of the arrow F, whereby the brush 28 returns to its position for contact with the drum 12. During such return motion, the tip 51*a* of the feed pawl 51 moves past one tooth formed in the edge of the ratchet wheel 50, thus returning to the condition shown in FIG. 5.

As a result of such arrangement of the invention, the striker rod 36 is incrementally rotated through a given angle in one direction to change its surface area which comes to bear against the brush 28 each time a multiple copy operation takes place. Accordingly, the toner deposition on the surface of the striker rod is substantially eliminated, allowing the striker rod to be effective for a prolonged period of the use to enable an effective removal of toner from the brush 28 to be maintained.

Instead of causing an angular movement of the striker rod 36 in one direction in association with the movement of the cleaning brush 28 away from the drum 12 as in the embodiment described above, it should be understood that the striker rod 36 may be angularly driven in association with the movement of the brush 28 into contact with the drum 12. In addition, the mechanism which is utilized to cause an angular movement of the striker rod in association with the angular movement of the arm 35*b* is not limited to the combination of the ratchet wheel and the feed pawl, but various other mechanisms may be equally used.

What is claimed is:

1. A cleaning apparatus for a photosensitive member of an electrophotographic machine, comprising a cleaning brush disposed to be movable into contact with or away from a photosensitive member which is adapted to carry an electrostatic latent image thereon, the brush being disposed to be maintained in contact with said photosensitive member while rotating to remove therefrom unnecessary developing toner which attaches to the photosensitive member;

trap means for collecting unnecessary developing toner removed by the cleaning brush;

a striker rod disposed in abutment against the cleaning brush and to be rotatable for removing developing toner from the brush;

and drive means for causing an angular movement of the striker rod through a given angle in association with the movement of the cleaning brush into contact with or away from the photosensitive member.

2. A cleaning apparatus according to claim 1 further including means for normally maintaining the cleaning brush in contact with the photosensitive member and for moving the cleaning brush away therefrom when a multiple copy is to be produced from an electrostatic latent image formed on the photosensitive member, and for returning the cleaning brush to its original position for contact with the photosensitive member upon completion of the multiple copy operation.

3. A cleaning apparatus according to claim 1 in which the cleaning brush includes a rotary shaft, the opposite ends of which are carried by a pair of rockable arms so as to be movable into contact with or away from the photosensitive member as the arms rock.

4. A cleaning apparatus according to claim 1 in which the striker rod is rotatably mounted on a stationary member and is disposed on the path of rotation of the cleaning brush.

5. A cleaning apparatus according to claim 3 in which the drive means associated with the striker rod comprises a ratchet wheel fixedly mounted on one end of the striker rod, and a feed pawl mounted on one of the rockable arms associated with the cleaning brush and actuated by movement of said rockable arm, the movement of the feed pawl causing an angular movement of the ratchet wheel in one direction to cause an angular movement of the striker rod as one of the rockable arms rocks to move the cleaning brush away from or into contact with the photosensitive member.

6. A cleaning apparatus for a photosensitive member of an electrophotographic machine, comprising:

a cleaning brush mounted for movement relative to a photosensitive member which is adapted to carry an electrostatic latent image thereon, said cleaning brush being disposed to be maintained in contact with said photosensitive member while the latter is rotating to remove therefrom unnecessary developing toner which attaches to the photosensitive member;

trap means for collecting unnecessary developing toner removed by the cleaning brush;

a striker rod mounted in contact with said cleaning brush and mounted for rotation for removing developing toner from said brush;

drive means for moving said cleaning brush relative to said photosensitive member; and means responsive to said drive means and the movement of said cleaning brush for causing an angular movement of the striker rod through a given angle in association with the movement of said cleaning brush.

* * * * *